United States Patent [19]

Cholewczynski

[11] Patent Number: 5,022,360

[45] Date of Patent: Jun. 11, 1991

[54] VALVE ACTUATOR FOR OVERHEAD CAMSHAFT ENGINE

[75] Inventor: Ludwik Cholewczynski, Windsor, Canada

[73] Assignee: Chrysler Corporation, Highland Park, Mich.

[21] Appl. No.: 597,237

[22] Filed: Oct. 15, 1990

[51] Int. Cl.[5] ..... F01L 1/18

[52] U.S. Cl. ..... 123/90.27; 123/90.45; 123/90.39

[58] Field of Search ..... 123/90.2, 90.27, 90.39, 123/90.41, 90.42, 90.43, 90.44, 90.45, 90.46, 90.47

[56] References Cited

U.S. PATENT DOCUMENTS

| | | | |
|---|---|---|---|
| 1,498,432 | 2/1985 | Hara et al. | 123/90.16 |
| 4,526,142 | 7/1985 | Hara et al. | 123/90.16 |
| 4,607,600 | 8/1986 | Yoshizaki | 123/90.16 |
| 4,611,558 | 9/1986 | Yoshizaki et al. | 123/90.16 |
| 4,612,887 | 9/1986 | Yoshizaki | 123/90.16 |
| 4,617,880 | 10/1986 | Yoshizaki | 123/90.16 |
| 4,768,467 | 9/1988 | Yamada et al. | 123/90.44 |
| 4,844,023 | 7/1989 | Konno et al. | 123/90.16 |
| 4,944,256 | 7/1990 | Matayoshi et al. | 123/90.46 |

FOREIGN PATENT DOCUMENTS

| | | | |
|---|---|---|---|
| 0051119 | 3/1984 | Japan | 123/90.39 |
| 0024104 | 1/1989 | Japan | 123/90.4 |

*Primary Examiner*—David A. Okonsky
*Assistant Examiner*—Weilun Lo
*Attorney, Agent, or Firm*—Kenneth H. MacLean

[57] ABSTRACT

In an overhead camshaft type engine, a valve actuation assembly including an elongated rocker arm finger follower, one end portion of which engages an end of the engine valve, a mid-portion of which engages the camshaft and another end of which is supported by a pivotal connection provided by an arm portion of an adjusting member having a body portion rotatable about a support shaft. Another arm portion of the adjusting member is engaged by an extendable valve lash adjuster which effectively moves the finger follower about the end of the valve and engages the follower with the camshaft at all times.

10 Claims, 2 Drawing Sheets

VALVE ACTUATOR FOR OVERHEAD CAMSHAFT ENGINE

BACKGROUND OF THE INVENTION

1. Field of the Invention

This application concerns an overhead camshaft type engine with an elongated multi-part valve actuator assembly between the camshaft and the valves. The actuator assembly has one end pivotally connected to a shaft and an opposite end engaged against an upper end of an engine valve. The construction of the multi-part actuator assembly allows rotation near its mid-portion adjacent to a roller follower supported for engaging a camshaft lobe. The cylinder head supports an extendable lash adjuster which urges the roller follower into engagement with the camshaft lobe.

2. Description of Related Art

The U.S. Pat. No. 4,848,285 to Konno, dated July 18, 1989, discloses a solid (single part) rocker arm 7 (9) for a valve 1*a* (1*b*) and as operated by lobe portion 3. Another solid (single part) rocker arm 8 engages the valves and is controlled by lobe 5. There is no teaching of a multi-part rocker arrangement nor the use of a hydraulic lash adjuster to urge a pivotally connected rocker against a cam lobe and a valve end surface.

The U.S. Pat. Nos. 4,607,600; 4,611,558; and 4,612,887; 4,617,880 to Yoshizaki, disclose a multi-part rocker arm which is foldable at a midpoint when a locking pin is moved to selected position. When the locking pin is moved to another selected position, the two main portions of the rocker arm are formed into a solid (non-foldable) rocker arm configuration. The purpose of these devices is to render certain valves inoperative at a given engine condition. Likewise, U.S. Pat. No. 4,844,023 to Konno discloses a similar arrangement for the same purpose.

The U.S. Pat. Nos. 4,498,432 and 4,526,142 to Hara et al. disclose multi-part rocker arms in which two members are positioned one on top of another. In combination with a selectively extendable lash adjuster, the combination of members proves variable valving action by altering the fulcrum.

SUMMARY OF THE INVENTION

This application discloses an efficient construction for an engine valve actuation assembly particularly for an overhead camshaft type cylinder head engine. Many modern engines of this overhead camshaft type have a solid (single piece) rocker arm used to actuate a valve in response to passage of a camshaft lobe. Typically, in these engines, one end of the rocker arm engages an end portion of an extendable hydraulic lash adjuster or a solid valve adjustment post, either of which is hereafter referred to as a valve adjustment means. An opposite end of the rocker arm engages the upper end surface of a valve stem. A midportion of the rocker arm is engaged by the camshaft. Passage of the lobe past the rocker arm causes it to pivot generally about the end of the valve adjustment means. The action of the lobe sliding over the rocker arm tends to submit the valve adjustment means to significant lateral loads. Thus, the valve adjustment means must be designed to withstand these forces. Resultantly, its construction must significantly more substantial and bulkier than otherwise. Accordingly, the elimination of lateral forces upon a valve adjustment means is an object of the subject design.

Another disadvantage of the one piece rocker arm design described above is the necessity of placing the valve adjustment means relatively near the camshaft. For the desirable object of designing an engine having a low height so as to fit under the low sloping hood of a modern vehicle, it is usually desirable to space the valve adjustment means laterally outward from the engine's centerline. With a one piece rocker arm, this cannot be done since the distance from the valve would be great and this would greatly increase necessary extension capabilities of the valve adjustment means. Accordingly, it would need to be unusually large, thus defeating the advantages of moving it outward from the centerline.

The subject multi-part rocker arm arrangement allows a designer to move the valve adjustment means laterally outward from the engine centerline without radically effecting the design or functional characteristics of the adjustment means. Specifically, the multi-part rocker assembly includes a finger follower portion whose midportion engages the camshaft and one end of which engages the valve. A second opposite end of the finger follower is pivotally connected to a first arm or lever portion of an adjusting member which is supported by a shaft so that it can rotate thereabout. The adjusting member also has a second arm or lever portion which is engaged by the extendable valve adjustment means. As the valve adjustment means and the support of the adjusting member moves outward, the effect of the valve adjustment means is multiplied by the ratio between the first and second levers. Thus, the construction of the valve adjustment means is unaffected.

Therefore, an object of this invention is to provide an efficient multi-part, pivoted rocker arm assembly exerting only axial forces on a valve adjustment means.

Another object of the invention is to provide an efficient, multi-part valve actuating rocker arm assembly utilizing a camshaft and valve engaging finger follower portion which is pivotally attached to a first projecting arm of an adjusting member which is mounted to rotate on a fixed shaft. The adjusting member has a second arm engaged by a valve adjustment means such as a hydraulic lash adjuster to urge the finger follower into contact with the camshaft. Accordingly, the valve adjusting means and adjustment member may be positioned laterally from the engine centerline without effecting the construction or functional specifications of the valve adjustment means. Still further objects and advantages of the subject improved valve activation arrangement will be more readily understood after a reading of the following detailed description of a preferred embodiment, reference being to the drawings thereof, described below.

IN THE DRAWING

FIG. 1 is a cross-sectional elevational view of the cylinder head of an overhead camshaft type internal combustion engine with the subject valve actuation apparatus; and FIG. 2 is a fragmentary top planar view of the valve actuation apparatus shown in FIG. 1; and FIG. 3 is a top planar view of a pivotal adjusting support member shown in FIGS. 1 and 2; and FIG. 4 is a side elevational view of the pivotal adjusting support member; and FIG. 5 is an end elevational view of the pivotal adjusting support member; and FIG. 6 is a sectional view of the pivotal adjusting support member taken along section line 6—6 in FIG. 3 and looking in the direction of the arrows; and FIG. 7 is a side elevational view of a rocker arm finger follower shown in FIGS. 1 and 2; and FIG. 8 is an elevational view of the right end of the rocker arm finger follower shown in FIG. 7; and FIG. 9 is a planar view of the rocker arm finger follower looking upward at its bottom surface; and FIG. 10 is a sectioned view of the rocker arm finger follower taken along section line 10—10 in FIG. 9 and looking in the direction of the arrows; and FIG. 11 is a sectioned view of the rocker arm finger follower taken along section line 11—11 in FIG. 7 and looking in the direction of the arrows; and FIG. 12 is a sectioned view of the rocker arm finger follower taken along section line 12—12 in FIG. 7 and looking in the direction of the arrows.

DETAILED DESCRIPTION OF A PREFERRED EMBODIMENT

Figure 1:
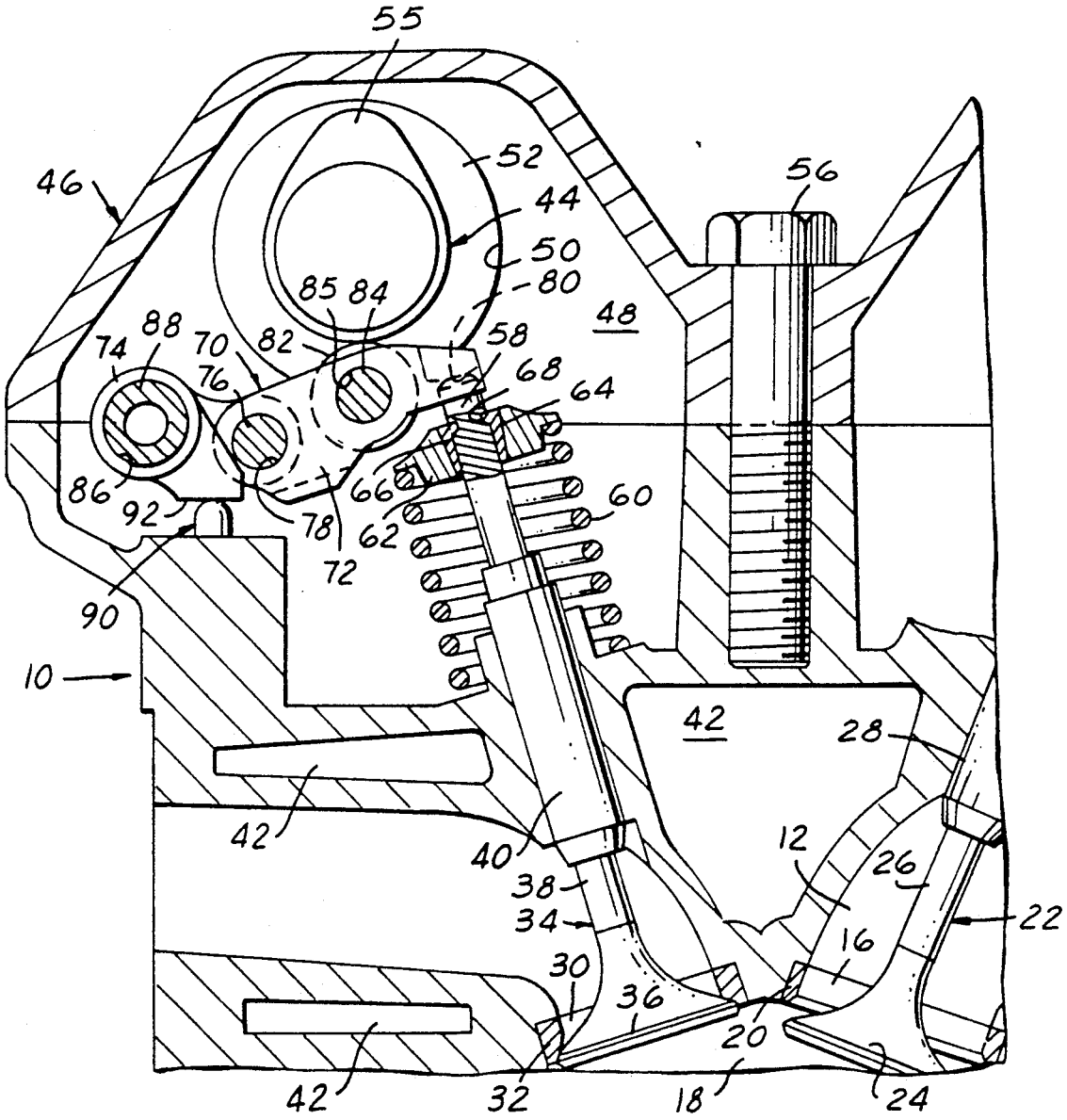
Figure 2:
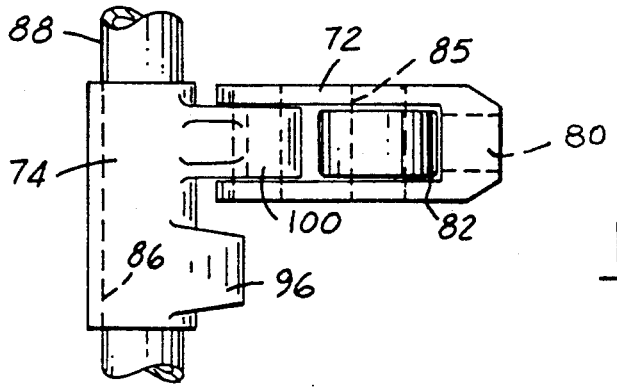
Figure 6:
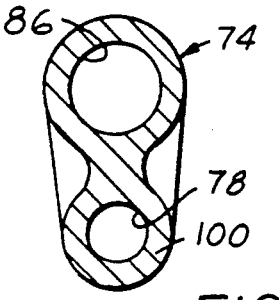

In FIG. 1, a portion of a dual overhead camshaft type cylinder head 10 for an internal combustion engine is shown in cross-section. The cylinder head 10 is adapted to be attached to an engine block (not shown) as is conventional in the engine art. The engine block is positioned below the cylinder head as shown in FIG. 1. Cylinder head 10 has air intake passages 12 (only a portion of one is shown in FIG. 1). Cylinder head 10 also has exhaust gas passages 14 (only one is shown in FIG. 1). The intake passage 12 directs air and fuel (from an injector not visible) to an inlet opening 16 of a combustion chamber 18. The combustion chamber 18 if formed by a cylindrical bore in the engine block and defined between a movable piston and the cylinder head 10. The inlet opening is encircled by an annulus in the form of a hard metal valve seat member 20. The flow of air and fuel into the combustion chamber 18 is controlled movements of an inlet valve 22 (shown in an open operational position). Specifically, the inlet valve includes a radially enlarged end or head portion 24 and an elongated stem portion 26. Stem portion 26 extends through a bore in a valve guide insert 28 fixed within the cylinder head 10. The inlet valve 22 is movable in the axial direction of the stem portion 26 between the open position shown in FIG. 1 and a closed position in which the enlarged head portion 24 engages the valve seat 20.

An outlet port 30 is also formed in the cylinder head 10 and communicates the combustion chamber 18 with the exhaust passage 14 for the purpose of flowing products of combustion from the chamber 18. The exhaust port 30 is encircled by an annulus in the form of a hardened metal valve seat member 32. The flow of fluid is controlled by a movable exhaust valve member 34. Like inlet valve 22, the exhaust valve 34 has an enlarged head portion 36 which engages the valve seat member 32 when in the illustrated closed operational position. Valve member 34 also has an elongated stem portion 38 which extends through a valve guide member 40. Guide member 40 is fixed to the cylinder head 10 and allows the valve 34 to move axially between the illustrated closed position and an open position.

When the engine is operated under load, the combustion chamber 18 and the exhaust passage 14 pass a significant quantity of hot gases. Accordingly, the cylinder head 10 is cooled by several interconnected liquid coolant filled passages 42 connected to a pump and a radiator. This permits the transfer of large quantities of heat from the cylinder head 10 to atmosphere.

As previously stated, both the inlet and the exhaust valves 22, 34 are movable between closed and opened positions. In a dual overhead camshaft type engine as illustrated, the inlet and exhaust valves are moved axially or operated by the effects of separate inlet and exhaust camshafts. However, in FIG. 1, only an exhaust valve camshaft 44 is illustrated in a position to actuate the exhaust valves. It should be noted that the inlet valves are actuated in a similar manner by a separate inlet camshaft and valve gear positioned to the rightward portion of the cylinder head shown in FIG. 1.

The illustrated camshaft 44 is supported for rotation by a valve and camshaft cover member 46. Member 46 include laterally extending wall portions 48 (only one shown) located between combustion chambers. The wall portions 48 have an opening 50 therethrough. When the camshaft is assembled to the member 46, the opening 50 receives an enlarged diameter journal portion 52 of the camshaft 44. Between the journal portions 52, the camshaft 44 has lobes formed thereon (only one lobe 54 is shown). Note that the diameter of the opening 50 and bearing journal 52 is greater than the radially outward extent of the lobe 54. Resultantly, the camshaft 44 can be installed and removed from the end of the member 46. Also, note that the cover member 46 is attached to the cylinder head 10 by fasteners 56 (only one shown) which are positioned along the centerline of the cover member 46. The cover member 46 is also intended to be fastened to the cylinder head 10 along its outer edges by fasteners (not shown).

The actuation of the engine valves will be describe with reference to FIG. 1 and specifically the exhaust valve 34. It should be understood that actuation of the other exhaust and the inlet valves is by the same means and by similar mechanisms. An upper end portion 58 of the exhaust valve stem 38 extends upward from the valve guide 40. This upper end portion of the stem passes centrally through a coil type valve spring 60. The lower end of the spring 60 seats against the cylinder head 10. The upper end engages a retainer collar 62. The retainer collar 62 is secured to the valve's stem in a given axial location by use of a pair of locking members 64, 66. Each of the members 64, 66 have an inwardly projecting portion which extend into a groove 68 in the valve stem adjacent end 58. The outer surfaces of the members 64, 66 are tapered as shown. Also, the aperture through the retainer 62 is similarly tapered. Resultantly, a axially expansive force of the spring 60 engages the tapered surfaces so that the retainer 62 and locking members 64 and 66 are secure. Together, they transmit the upward expansive force of the spring 60 to the valve 34. This tends to urge the head portion 36 of the valve 34 in the illustrated closed position against valve seat 32.

To operate the valve 34 or move it to a more opened position, the top end surface of the valve's end portion 58 is contacted by a multi-piece actuator assembly 70. The Actuator assembly 70 includes a rocker arm finger follower member 72 and a pivotal adjusting and support member 74. The members 72 and 74 are positioned in end to end relationship to one another and connected at adjacent ends. Specifically, adjacent first ends of the members 72 and 74 are connected together by a pin 76 which extends through corresponding openings 78 in the members. This allows the members 72 and 74 to pivot with respect to one another. An opposite second end of the rocker arm finger follower member 72 (to the right in FIG. 1) defines a contact surface 80 adapted to engage the upper end surface of valve 34. The finger follower member 72 also supports a roller member 82 at its mid-portion. The roller 82 is secured by a pin or shaft 84 which extends through bore 85.

The opposite second end of member 74 (to the left in FIG. 1) has a cylindrical bore or aperture 86 adapted to receive a shaft 88. Shaft 88 is mounted in cylindrical apertures formed in the cylinder head and the wall 48 of cover member 46. Resultantly, shaft 88 supports the assembly 70 and permits adjusting member 74 to rotate thereabout. Accordingly, counterclockwise rotation or pivoting of adjusting member 74 about the axis of shaft 88 will tend to move connecting pin 76 upward or generally clockwise relative to the upper end 58 of valve 34. Also, this tends to move the roller 82 into firm engagement with the lobe portion 54 of camshaft 44.

The adjusting member 74 is urged in the aforementioned counterclockwise direction by extension of a hydraulic lash adjuster, the extendable end portion 90 of which is visible in FIG. 1. Since the construction of a typical hydraulic lash adjuster is well known in the engine art, it is unnecessary to illustrate the entire adjuster or its interior portions for an understanding of the present invention. The lash adjuster for use with the subject valve actuating system operates similarly to know lash adjusters. Specifically, the body of the lash adjuster is supported within a recess in the cylinder head, leaving only the upper end 90 visible in FIG. 1. The lash adjuster is fluidly connected to a pressurized oil passage in the cylinder head 10. The pressurized oil is utilized to exert an upward force against the adjusting member 74. Specifically, the upper end 90 of the lash adjuster engages a flat surface 92 formed on the member 74. Transmission of this upward force pivots the member 74 counterclockwise and resultantly the roller 82 against the cam lobe 54.

As previously explained, the construction and arrangement of the present valve actuation assembly offers several advantages. One important advantage is that lateral (non-axial) forces on the lash adjuster are eliminated and therefore a smaller and less expensive adjuster may be utilized. Another important advantage is a greater degree of design flexibility gained by the use of the valve actuating arrangement which permits positioning the lash adjuster laterally from the valve. This can allow a lower design of the valve components important in modern vehicles where low engine hood lines are desired.

Figure 3:
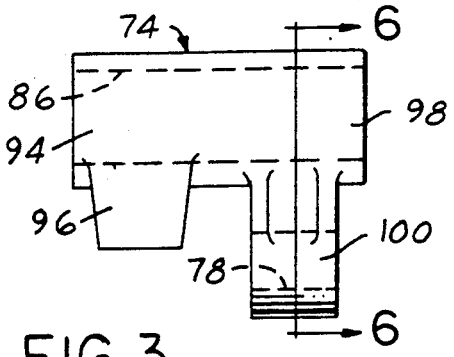
Figure 5:
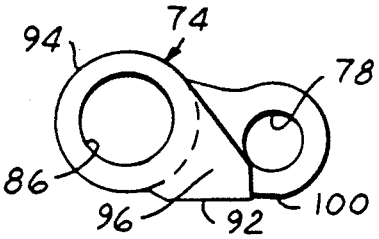
Figure 4:
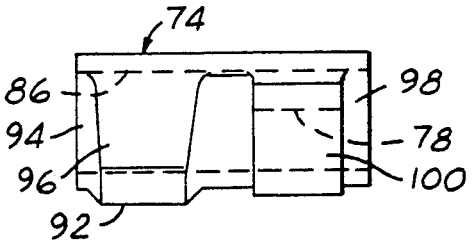
Figure 10:
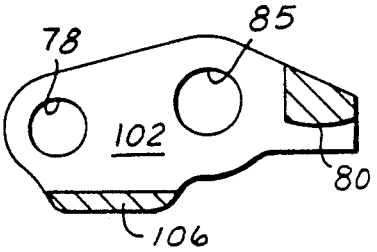
Figure 11:
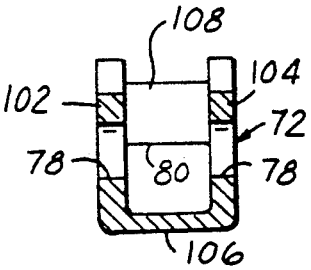
Figure 7:
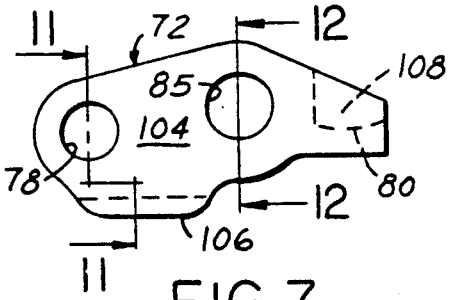
Figure 8:
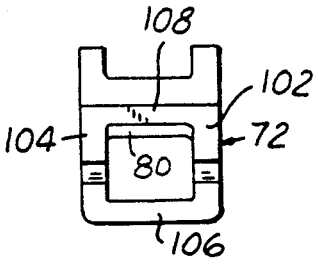
Figure 9:
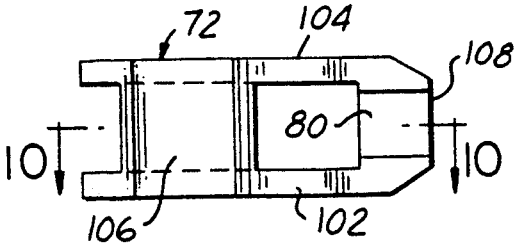

Details of the structure of the pivotal adjusting support member 74 is best understood by reference to FIG. 3-6. In FIGS. 3 and 4, the main body portion of member 74 has cylindrical opening 86 formed therethrough for receiving shaft 88. Adjacent the rightward end portion 94, a projecting portion 96 extends radially from the body portion. Portion 96 functions as a lever to rotate or pivot the member 74 when the surface 92 thereof is engaged by the portion 90 of the lash adjuster. The rightward end portion 98 of the member 74 also has a projecting portion 100 extending radially therefrom. Portion 100 has opening or bore 78 formed therethrough which receives the pin or shaft 84 when the members 72 and 74 are connected by pin 76.

Figure 12:
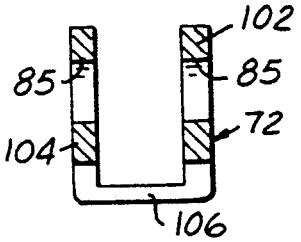

The structure of the rocker arm finger follower member 72 is best understood by reference to FIGS. 7-12. Referring to FIG. 12, the member 72 has a U-shaped structure defined by two parallel and spaced walls portions 102 and 104 integrally connected by a lower or bottom wall portion 106. Also, reference to FIG. 8 reveals an end connecting portion 108. The connecting portion 108 formes the surface 80 which is adapted to engage the upper end of the valve's stem portion. The U-shaped structure is lightweight, strong and particularly well adapted to support the roller cam follower 86 between the two wall portions 102 and 104.

Although only a single embodiment of the invention has been illustrated and described in detail, modifications are foreseeable which modifications still would be within the scope of the following claims which define the invention.

WHAT IS CLAIMED IS AS FOLLOWS:

1. An improved overhead camshaft type cylinder head for an engine with a multi-piece valve actuation apparatus, comprising: a cylinder head assembly having opposite sides, the cylinder head adapted to be secured to the engine along one of the opposite sides; a valve cover member secured to the other of the opposite sides of the cylinder head; an elongated camshaft supported for rotation by the cylinder head assembly in substantial parallelism with the one side, the camshaft having eccentric lobe portions; a valve associated with each lobe portion of the camshaft, each valve having an elongated stem portion with an axis extending substantially normal to the axis of the camshaft and with an end surface spaced from the camshaft; the multi-piece valve actuation apparatus including an adjusting member having an apertured body portion and first and second arms which extend radially therefrom, the first arm defining a contact surface thereon; the apparatus further including an elongated finger follower member with first and second ends, one of which defines a surface for engaging the end of the valve; means connecting the second arm of the adjusting member and the second end of the finger follower permitting the members to pivot with respect to one another; an extendable lash adjuster carried by the cylinder head and engaging the contact surface of the adjusting member whereby extension of the lash adjuster against the contact surface moves the second arm of the adjusting member and the connected second end of the finger follower toward the camshaft; means on the finger follower member to slidingly engage an associated camshaft lobe whereby the aforesaid movement of the finger follower pivots the finger follower member about the end of the valve stem and moves it into engagement with the cam lobe.

2. The cylinder head assembly as set forth in claim 1 in which the contact surface of the adjusting member's first arm defines a plane which is substantially normal to the extendable axis of the lash adjuster.

3. The cylinder head assembly as set forth in claim 1 in which the second arm of the adjusting member has an opening therethrough parallel to the axis of the camshaft; the second end of the finger follower member has an opening therethrough parallel to the axis of the camshaft whereby the openings are aligned; and pin means extending through the openings to pivotally connect the members.

4. The cylinder head assembly as set forth in claim 1 in which the second arm of the adjusting member projects radially from the body portion more than the distance between the center or rotation of the body portion and the contact with the valve lash adjuster whereby movement of the second arm and of the end of the connected finger follower member are greater than the extension movements of the valve lash adjuster.

5. For an internal combustion engine including a cylinder head assembly of the overhead camshaft type with at least one camshaft mounted thereby, an improved actuation apparatus for a valve, comprising: an engine cylinder head including a body portion and a valve cover member; an elongated camshaft having lobe portions; an engine valve associated with each lobe portion, each valve having an elongated stem portion having an end surface in close proximity to the associated lobe portion; a multi-piece valve actuation apparatus including an adjusting member having a body portion with a bore therethrough; a shaft supported by the cylinder head assembly parallel to the camshaft and extending through the bore of the adjusting member so as to permit rotation about the shaft; the adjusting portion having first and second arm portions radially projecting therefrom, the first arm having a contact surface thereon; an elongated finger follower member located in end to end relationship with respect to the second arm of the adjusting member; means connecting the second arm of the adjusting member with an end of the finger follower member allowing relative pivotal movement therebetween; an opposite end of the finger follower having a surface engaging the end of the valve stem; a roller member supported by the finger follower member for engagement with the associated camshaft lobe; an extendable lash adjuster positioned between the cylinder head and the contact surface of the adjusting member, extension of which rotates the adjusting member and resultantly pivots the finger follower member about the end of the valve stem and urges the roller into engagement with the cam lobe.

6. The valve actuation apparatus set forth in claim 5 in which apertures are provided in the second arm of the adjusting member and in the adjacent end of the finger follower member, the members being positioned so that the apertures have their axes aligned; a pin member extending through the openings connecting the second arm and the finger follower in end to end relationship permitting relative rotation therebetween.

7. The valve actuation apparatus set forth in claim 5 in which the contact surface of the adjusting member's first arm defines a plane which is substantially normal to the extendable axis of the lash adjuster.

8. The valve actuation apparatus set forth in claim 5 in which the second arm of the adjusting member projects radially from the body portion more than the distance between the center or rotation of the body portion and the contact with the valve lash adjuster whereby movement of the second arm and of the end of the connected finger follower member are greater than the extension movements of the valve lash adjuster.

9. The valve actuation apparatus set forth in claim 5 in which the finger follower member has spaced side walls and a bottom wall therebetween thereby defining a generally U-shaped structure with an opening formed therebetween; the side walls being bridged at the opposite end thus forming a portion therebetween defining the valve stem engaging surface.

10. The valve actuator apparatus set forth in claim 9 in which the side walls of the finger follower each has an aligned opening; a shaft extending through the openings to support the roller member in a position so that it extends from the side walls enabling contact with the camshaft.

* * * * *